US008022281B2

(12) United States Patent
Abe et al.

(10) Patent No.: US 8,022,281 B2
(45) Date of Patent: Sep. 20, 2011

(54) SHELL FOR DRUM AND DRUM USING THE SAME

(75) Inventors: Banri Abe, Hamamatsu (JP); Takuya Abe, Kakegawa (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 12/349,151

(22) Filed: Jan. 6, 2009

(65) Prior Publication Data

US 2009/0173209 A1 Jul. 9, 2009

(30) Foreign Application Priority Data

Jan. 9, 2008 (JP) ..... 2008-002220

(51) Int. Cl.
*G10D 13/02* (2006.01)

(52) U.S. Cl. ..... 84/414

(58) Field of Classification Search ..... 84/414, 84/411 R

See application file for complete search history.

(56) References Cited

U.S. PATENT DOCUMENTS

| | | | | |
|---|---|---|---|---|
| 6,291,752 | B1 | 9/2001 | Vergara | |
| 6,441,285 | B1 * | 8/2002 | Kurosaki | 84/411 R |
| 7,579,063 | B2 * | 8/2009 | Idestrup | 428/106 |
| 2009/0197036 | A1 * | 8/2009 | Hwang et al. | 428/99 |

FOREIGN PATENT DOCUMENTS

| | | | |
|---|---|---|---|
| EP | 1355292 | | 10/2003 |
| GB | 1 460 570 | | 1/1977 |
| JP | S53-47939 | | 11/1978 |
| JP | 11-045087 | A | 2/1999 |
| JP | 2001-067066 | A | 3/2001 |
| JP | 3324577 | B2 | 9/2002 |

* cited by examiner

*Primary Examiner* — Jianchun Qin
(74) *Attorney, Agent, or Firm* — Dickstein Shapiro LLP

(57) ABSTRACT

A shell for drum according to the present invention includes a laminated plywood-panel including a plurality of single-panels having different densities, the plurality of single-panels being jointed in decreasing order of density from a center portion in a thick direction of the laminated plywood-panel toward an outermost portion and an innermost portion, such that a single-panel having a highest density is arranged at the center portion, and single-panels having lowest densities are arranged at the outermost portion and the innermost portion.

4 Claims, 3 Drawing Sheets

SHELL FOR DRUM AND DRUM USING THE SAME

BACKGROUND OF THE INVENTION

1. Field of the Invention

The present invention relates to a shell for drum such as a bass drum, a snare drum, and a marching drum, and a drum using the same.

Priority is claimed on Japanese Patent Application No. 2008-002220, filed Jan. 9, 2008, the content of which is incorporated herein by reference.

2. Description of Related Art

A shell which a drum head of a drum is provided over in a tensioned state is normally made from various materials such as wood, metal such as aluminum alloy, and fiber reinforced plastic (FRP) (see for example Japanese Unexamined Patent Application, First Publication No. H11-45087, Japanese Patent Publication No. 3324577 {Japanese Unexamined Patent Application, First Publication No. 2001-67066}, and Japanese Examined Utility Model Application, Second Publication No. S53-47939). Most shells are made from wood, since this obtains a musically warm sound.

A wood of appropriate hardness and superior acoustical characteristics is used, e.g. maple, birch, beech, or bamboo.

A shell of a Japanese drum disclosed in Japanese Unexamined Patent Application, First Publication No. H11-45087 is made from a wooden material or a non-wooden material for the shell and has a polygonal shape. As the wooden material, a particle board, a fire board, bonded wood, laminated wood, plywood, or another material, are used. As the non-wooden material, synthetic resin material, glass fiber-filled resin material, carbon fiber-filled resin material, boron fiber-filled resin material, a compound material made by selectively using some of these materials, or another material, are used.

A shell of a drum disclosed in Japanese Patent Publication No. 3324577 is formed as follows. A joined plate is obtained by joining a plurality of elongated flat-plate-shaped bamboo materials in a width direction so that the top surfaces and under surfaces of these bamboo materials are alternatively inverted. A plurality of these joined plates are laminated to form a plywood-panel. The plywood-panel is joined in the width direction to form the shell.

A shell of a drum disclosed in Japanese Examined Utility Model Application, Second Publication No. S53-47939 is formed by joining long thin single-panels in a cylindrical shape.

Conventionally, in a drum made of plywood, the shell is basically formed by enclosing a single-panel having low specific gravity between single-panels having high specific gravity. Known examples of a shell formed by enclosing a single-panel having low specific gravity between plywood-panels having high specific gravity include maple (specific gravity: 0.7)+poplar (specific gravity: 0.45)+maple (specific gravity: 0.7), mahogany (specific gravity: 0.65)+poplar (specific gravity: 0.45)+mahogany (specific gravity: 0.65), and birch (specific gravity: 0.71)+meranti (specific gravity: 0.55)+birch (specific gravity: 0.71).

The reason that a single-panel having high specific gravity is used for the outer side is that this reduces the effects of changes in air temperature and climate, while maintaining the external appearance by increasing the strength of the outer surface and reducing problems such as damage and abrasion.

However, in a shell formed by enclosing a single-panel having low specific gravity between plywood-panels having high specific gravity, since the outer side of the single-panel having low specific gravity is pressed by the single-panel having high specific gravity, there is considerable loss of vibrational energy due to internal abrasion. This leads to problems that the vibration of drum is rapidly attenuated and the volume becomes relatively small.

Each of the drums disclosed in the references mentioned above has advantages and disadvantages that leave room for improvement. In the Japanese drum disclosed in Japanese Unexamined Patent Application, First Publication No. H11-45087, the tensile structure of the drum head has a special structure, and a conventional head frame cannot be used. The drum disclosed in Japanese Patent Publication No. 3324577 requires many steps to manufacture the bamboo plywood, increasing the manufacturing cost. As for the drum disclosed in Japanese Examined Utility Model Application, Second Publication No. S53-47939, when the shell is made using long thin single-panels, there is noticeable warping and the like due to drying and aging of these single-panels, and gaps are liable to appear between them.

SUMMARY OF THE INVENTION

The present invention has been conceived in order to solve the conventional problems described above. It is an object of the invention to provide a drum with superior acoustic characteristics without obstructing the vibration of the shell.

To solve these objects, the shell for drum according to the present invention includes a laminated plywood-panel including a plurality of single-panels having different densities, the plurality of single-panels being jointed in decreasing order of density from a center portion in a thick direction of the laminated plywood-panel toward an outermost portion and an innermost portion, such that a single-panel having a highest density is arranged at the center portion, and single-panels having lowest densities are arranged at the outermost portion and the innermost portion.

In the shell for drum according to the present invention, the plurality of single-panels may include a high-specific-gravity panel, a pair of left and right intermediate-specific-gravity panels, and a pair of left and right low-specific gravity panels, and the laminated plywood-panel may include the high-specific-gravity panel, the pair of left and right intermediate-specific-gravity panels which are joined to both faces of the high-specific-gravity panel, and the pair of left and right low-specific-gravity panels which are joined to an outer side of each of the intermediate-specific-gravity panels.

In the shell for drum according to the present invention, specific gravity of the high-specific-gravity panel may be between 0.9 and 1.3, specific gravity of the intermediate-specific-gravity panels may be less than 0.7 to 0.9, and specific gravity of the low-specific-gravity panels may be less than 0.5 to 0.7.

The drum according to the invention includes the shell for drum described above.

In the invention, the plurality of single-panels are jointed in decreasing order of density from a center portion in the thick direction of the laminated plywood-panel toward an outermost portion and an innermost portion, such that a single-panel having the highest density is at the center portion, and single-panels having the lowest densities are arranged at the outermost portion and the innermost portion. That is, the high-specific-gravity (high-rigidity) single-panel is arranged at the center portion, and low-specific-gravity (low-rigidity) single-panels are arranged at outermost and innermost portions. According to this configuration, the low-specific-gravity panels are unlikely to obstruct the vibration of the high-specific-gravity panel, whereby lingering vibrations and volume can be maintained. It is also possible to maintain a volume, ease of sound-production, and depth of sound (register width), that cannot be obtained by a shell having high specific gravity or high rigidity, thereby enhancing the acoustic characteristics.

DETAILED DESCRIPTION OF THE INVENTION

An embodiment of the present invention will be explained in detail with reference to the drawings.

Figure 1:
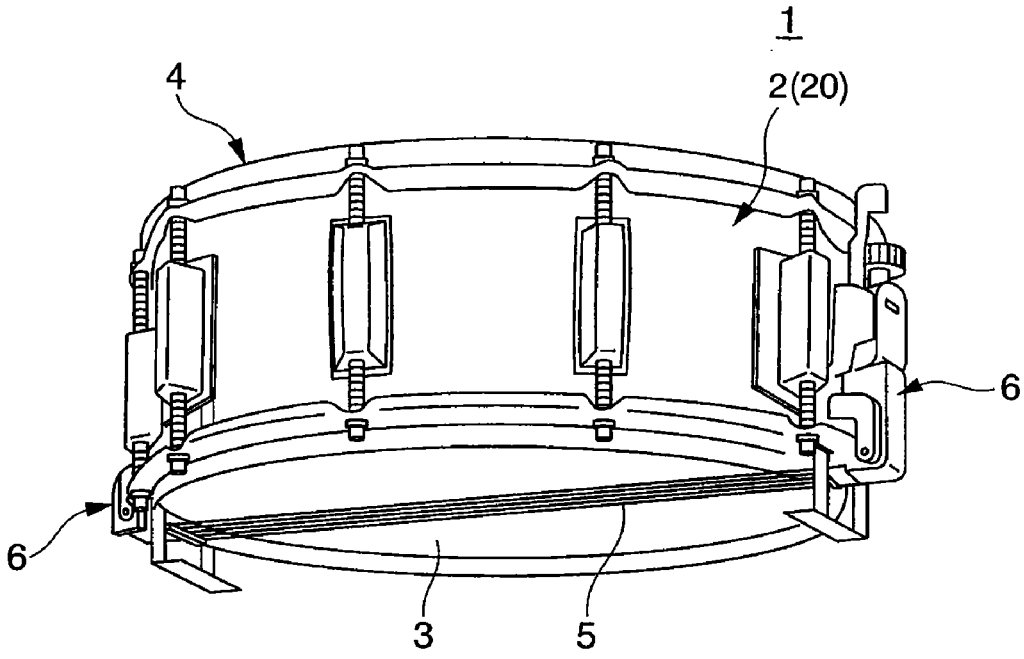
FIG. 1 is an external perspective view showing a snare drum according to an embodiment of the invention.
Figure 2:
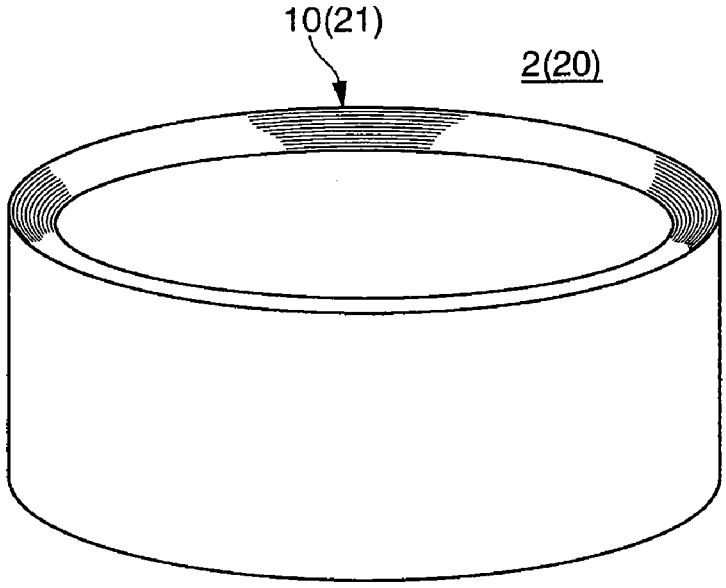
FIG. 2 is an external perspective view showing a shell of the snare drum shown in FIG. 1.
Figure 3:
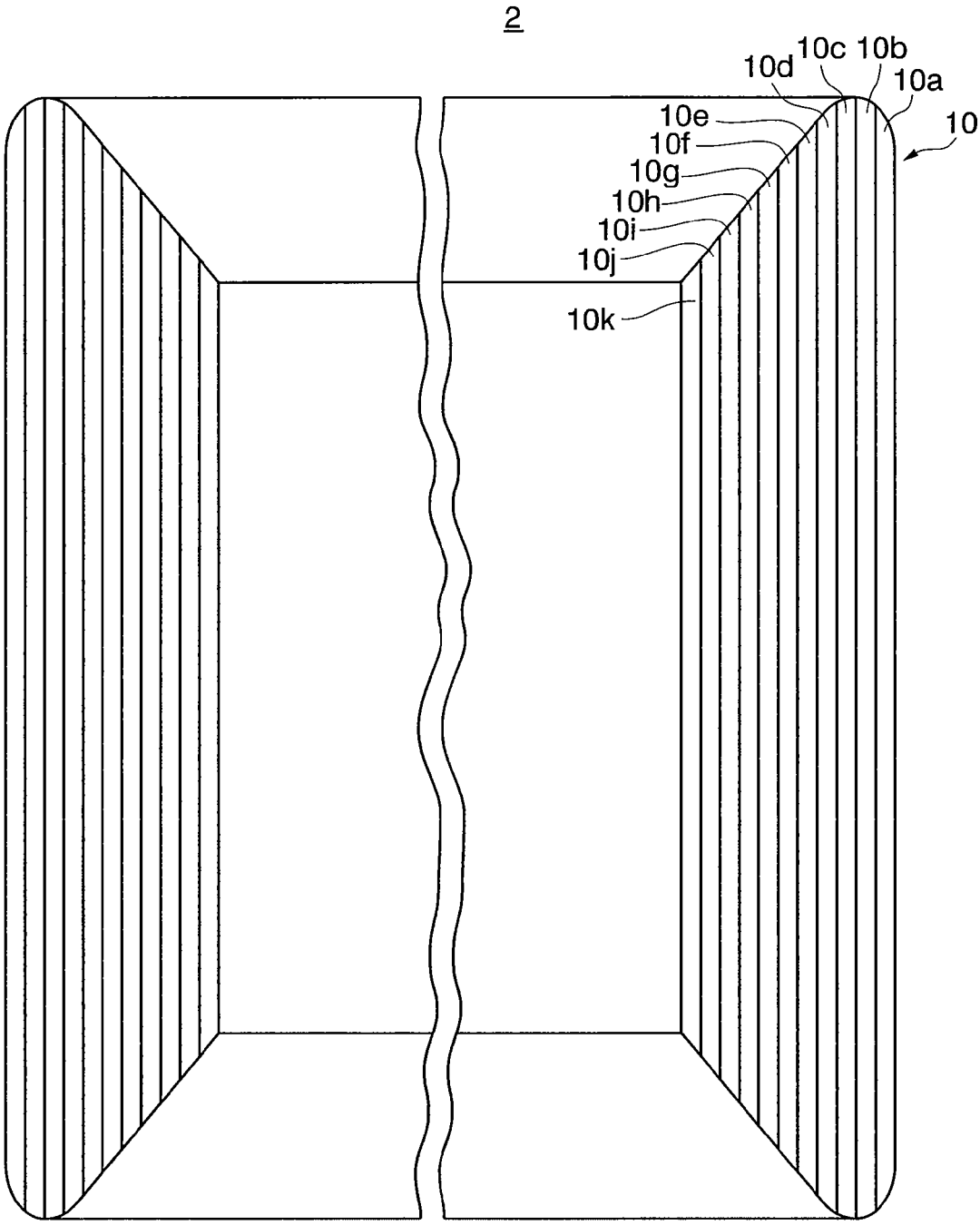
FIG. 3 is a cross-sectional view showing the shell of the snare drum shown in FIG. 1.
Figure 4:
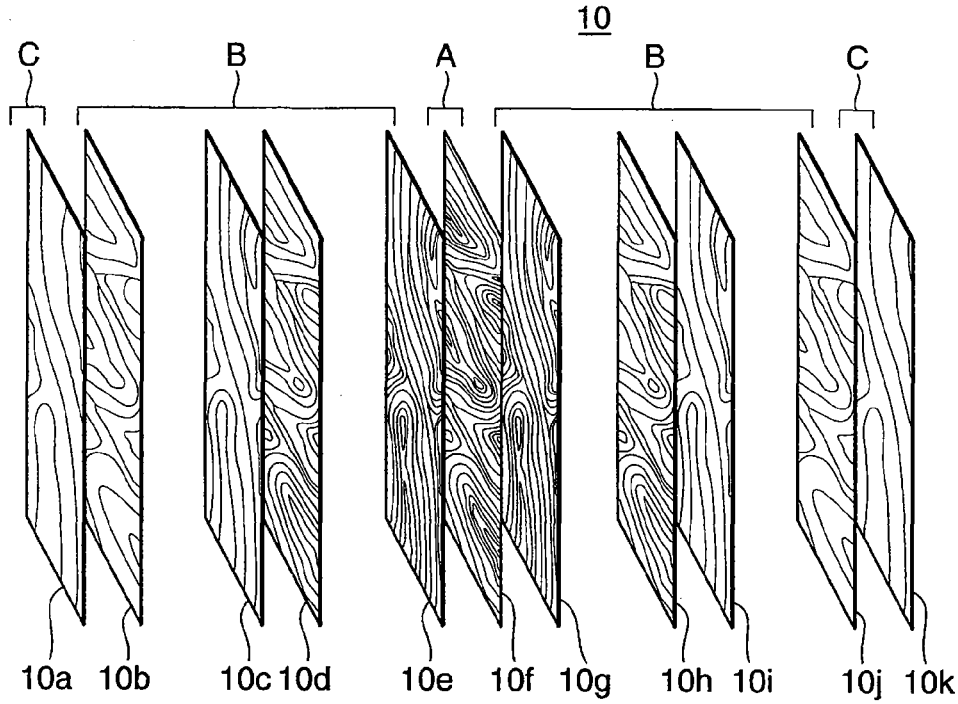
FIG. 4 is an exploded perspective view showing a plywood-panel constituting the shell of the snare drum shown in FIG. 1.

FIG. 1 is an external perspective view showing a snare drum according to an embodiment of the invention. FIG. 2 is an external perspective view showing a shell of the snare drum shown in FIG. 1. FIG. 3 is a cross-sectional view showing the shell of the snare drum shown in FIG. 1. FIG. 4 is an exploded perspective view showing a plywood-panel constituting the shell of the snare drum shown in FIG. 1. As shown in FIGS. 1 to 4, a snare drum 1 includes a shell 2, two drum heads 3, head-supporting tensile parts 4, a drum snare 5, a Backen mechanism 6, and so on. The shell 2 is formed in the shape of a cylinder with both ends open. The two drum heads 3 are provided such that they cover the two open ends of the shell 2 in a tensioned state. The head-supporting tensile parts 4 support the drum heads 3 in a tensioned state. The drum snare 5 is provided in a tensioned state over the drum head 3 on the bottom face side. The Backen mechanism 6 selectively makes the drum snares 5 contact or separate from the drum head 3 on the bottom face side.

The shell 2 is made from a laminated plywood-panel 10 that includes a plurality of (e.g. eleven) plywood single-panels 10*a* to 10*k* having different densities. This laminated plywood-panel 10 is formed by integrally joining the single-panels 10*a* to 10*k* such that a single-panel 10*f* having the highest density is at a center portion in the thick direction of the laminated plywood-panel 10 that constitutes the shell 2, and laminating the other single-panels such that their densities gradually decrease toward the top and bottom faces of the shell 2. In other words, the laminated plywood-panel 10 is formed by joining the single-panels 10*a* to 10*k* that are laminated in decreasing order of density from the center portion toward an outermost portion and an innermost portion of the laminated plywood-panel 10 such that the single-panel 10*f* having the highest density is arranged at the center portion of the thick direction of the laminated plywood-panel 10 and the single-panels 10*a*, 10*k* having lowest densities are arranged at the outermost portion and the innermost portion. Consequently, the laminated plywood-panel 10 includes a panel having high specific gravity A that constitutes the center portion in the thick direction, a pair of left and right panels having intermediate specific gravity B which are joined to both faces of the high-specific-gravity panel A, and a pair of left and right panels having low specific gravity C which are joined to the outer side of each intermediate-specific-gravity panel B.

The high-specific-gravity panel A is constituted by one single-panel 10*f*. A single-panel having specific gravity of between 0.9 and 1.3, which is made of such as Jatoba (specific gravity: 0.9) from Central and South America, Bubing a, rosewood, or Indian ebony, is used as this single-panel 10*f*.

The intermediate-specific-gravity panels B are each constituted by laminating four single-panels 10*b* to 10*e* and 10*g* to 10*j*. A single-panel having specific gravity of between 0.7 and less than 0.9, which is made of such as maple (specific gravity: 0.7) and birch (specific gravity: 0.71) which have high specific gravity, or Keruing, Apitong, Kapur, etc is used as the single-panels 10*b* to 10*e* and 10*g* to 10*j*.

The low-specific-gravity panels C are each constituted by one of the single-panels 10*a* and 10*k*. A single-panel having specific gravity of less than 0.5 to 0.7, which is made of such as poplar (specific gravity: 0.45), melanti (specific gravity: 0.55), mahogany (specific gravity: 0.65), or low-specific-gravity maple, birch, elm, ash, and the like, is used as the single-panels 10*s* and 10*k*.

The shell 2 is made as follows. The single-panels 10*a* to 10*k* are coated with an adhesive, sequentially laminated, and dried until the adhesive hardens, thereby obtaining the laminated plywood-panel 10 for forming the shell. The laminated plywood-panel 10 for forming the shell is rolled up to a cylinder shape having a predetermined diameter, and both its ends are then joined to each other. End faces of a cylindrical body are cut to obtain sloping faces that slope at a desired sloping angle toward the inside as shown in FIG. 3, in addition, holes for attaching lags are formed. A protective coating is then applied to the outer surface.

The drum 1 including the shell 2 with such a structure has a lower vibration damping factor than a conventional drum including a shell in which a low-specific-gravity single-panel is enclosed between high-specific-gravity single-panels. This makes it possible to obtain a drum with a non-vibration-suppressing structure which continues to vibrate. A drum having acoustic characteristics of a degree of excellence lacked by conventional drums, namely superior volume, ease of sound-production, and depth of sound (register width), can thus be provided. It is believed that these acoustic characteristics are due to the positioning of the high-specific-gravity panel A on the inner side, whereby its vibrations cannot easily be suppressed by the intermediate-specific-gravity panels B and the low-specific-gravity panels C.

Table 1 illustrates the logarithmic damping factors of sound when the low-specific-gravity panels C (Khiva) are arranged at the center and the high-specific-gravity panel A is arranged on the outside, and when the high-specific-gravity panel A (Jatoba) is arranged at the center and the low-specific-gravity panels C are arranged on the outside.

TABLE 1

| | Shell Size | | | |
|---|---|---|---|---|
| Central Panel | 10 inches | 12 inches | 16 inches | 22 inches |
| Low-specific-gravity panel (Khiva) | 58 | 41.1 | 54 | 47.9 |
| High-specific-gravity panel (Jatoba) | 26 | 29 | 44 | 40 |

As clearly shown in Table 1, a shell in which the high-specific-gravity panel A is arranged at the center and the low-specific-gravity panels C are arranged on the outside can reduce the logarithmic vibration damping factor to lower than that of a shell in which the low-specific-gravity panel C is arranged at the center and the high-specific-gravity panels A are arranged on the outside.

Figure 5:
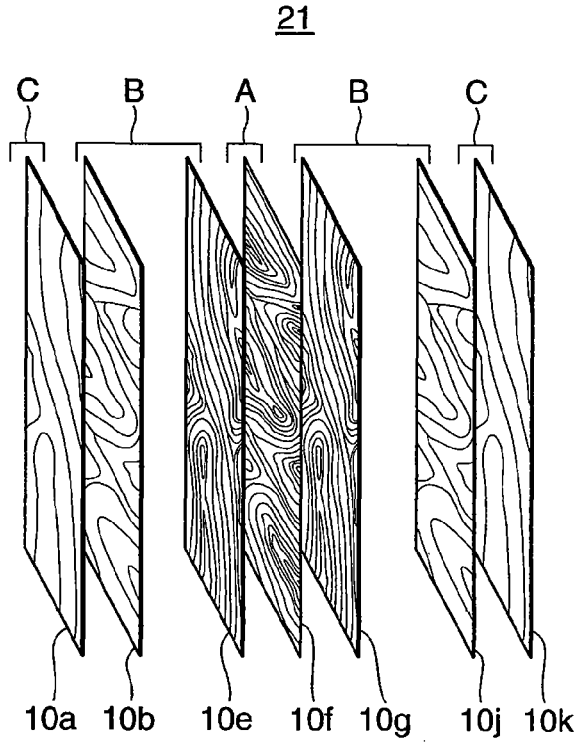
FIG. 5 is an exploded perspective view showing a plywood-panel constituting a shell according to another embodiment of the invention.

FIG. 5 is an exploded perspective view showing a plywood-panel constituting a shell according to another embodiment of the present invention.

A shell 20 according to this embodiment differs from the laminated plywood-panel 10 in the embodiment described earlier only in that a laminated plywood-panel 21 is formed by seven single-panels 10*a* to 10*b*, 10*e* to 10*g*, and 10*j* to 10*k*, four of the single-panels 10*c*, 10*d*, 10*h*, and 10*i* that constitute the intermediate-specific-gravity panels B shown in FIG. 3 being excluded, and its configuration is otherwise exactly the same. Like constituent members are therefore designated with like reference numerals, and are not repetitiously explained.

Likewise in the shell 20 with this structure, a high-specific-gravity panel A is arranged in the center of the thick direction of the laminated plywood-panel 21, intermediate-specific-gravity panels B are arranged on both sides thereof, and low-specific-gravity panels C are additionally arranged on both sides thereof. Effects similar to those of the embodiment already described are thus obtained.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

For example, the high-specific-gravity panel A and the low-specific-gravity panels C are each formed from one single-panel 10*f*, 10*a*, and 10*k* respectively, the invention is not limited to this configuration, and laminated plywood-panels of three or more single-panels can be used instead.

What is claimed is:

1. A shell for a drum comprising:

at least one high-specific-gravity panel;

at least one pair of left and right intermediate-specific-gravity panels; and at least one pair of left and right low-specific gravity panels, wherein panels are joined in decreasing order of density from a center portion in a thickness direction of the drum shell toward an outermost portion and an innermost portion, the at least one high-specific-gravity panel being arranged at the center portion, the at least one pair of left and right intermediate-specific-gravity panels being joined to both faces of the high-specific-gravity panel, and the at least one pair of left and right low-specific-gravity panels being joined to an outer side of each of the intermediate-specific-gravity panels.

2. The shell for a drum according to claim 1, wherein specific gravity of the high-specific-gravity panel is between 9 and 1.3, specific gravity of the intermediate-specific-gravity panels is less than 0.7 to 0.9, and specific gravity of the low-specific-gravity panels is less than 0.5 to 0.7.

3. A drum including the shell for drum according to claim 1.

4. A shell for a drum comprising:

a laminated plywood-panel including a plurality of single-panels having different densities, the plurality of single-panels being joined in decreasing order of density from a center portion in a thick direction of the laminated plywood-panel toward an outermost portion and an innermost portion, such that a single-panel having a highest density is arranged at the center portion, and single-panels having the lowest densities are arranged at the outermost portion and the innermost portion, whereby the lowest density single panels at the outermost and innermost portions obstruct less of the vibration of the at least one highest density panel, thereby enhancing the acoustic characteristics of the shell, and wherein at least two pairs of single-panels having decreasing densities are arranged toward the outermost portion and the innermost portion.

* * * * *